United States Patent [19]

Anderson et al.

[11] 4,036,434

[45] July 19, 1977

[54] FLUID DELIVERY NOZZLE WITH FLUID PURGED FACE

[75] Inventors: Roger E. Anderson, Rancho Cordova; Emil Schmauderer, Jr., Folsom, both of Calif.

[73] Assignee: Aerojet General Corporation, El Monte, Calif.

[21] Appl. No.: 488,472

[22] Filed: July 15, 1974

[51] Int. Cl.[2] ..... B05B 7/00; B05B 15/02

[52] U.S. Cl. ..... 239/8; 239/112; 239/145; 239/424; 239/558

[58] Field of Search ..... 239/104, 105, 112, 113, 239/132, 132.1, 132.3, 132.5, 145, 343, 364–366, 368, 369, 370, 371, 424, 424.5, 425, 558, 8–10, 1

[56] References Cited

U.S. PATENT DOCUMENTS

| | | | |
|---|---|---|---|
| 2,612,405 | 9/1952 | Kirschbaum | 239/404 |
| 3,224,677 | 12/1965 | Schmidt et al. | 239/101 |
| 3,245,622 | 4/1966 | McBride | 239/424 X |
| 3,391,084 | 7/1968 | York | 252/154 X |
| 3,583,635 | 6/1971 | Lemelson | 239/145 |
| 3,622,077 | 11/1971 | Wiegand | 239/424 X |
| 3,777,983 | 12/1973 | Hibbins | 239/425 X |

FOREIGN PATENT DOCUMENTS

| | | | |
|---|---|---|---|
| 856,377 | 12/1960 | United Kingdom | 252/89 |

*Primary Examiner*—Robert S. Ward, Jr.
*Attorney, Agent, or Firm*—Townsend and Townsend

[57] ABSTRACT

A nozzle for use in delivering a primary fluid having solids in solution or suspended therein which gives the fluid nozzle-caking tendencies. The nozzle has a first passage through which the primary fluid passes and a second passage through which a purging fluid passes, each passage terminating at an exit orifice. The orifice of the first passage is unrestricted and the orifice of the second passage has means for distributing the purging fluid in a manner to form a low velocity fluid buffer to inhibit caking of the solids of the nozzle due to reverse flow of the primary fluid caused by a circulating action thereof immediately after leaving the exit orifice of the first passage.

23 Claims, 9 Drawing Figures

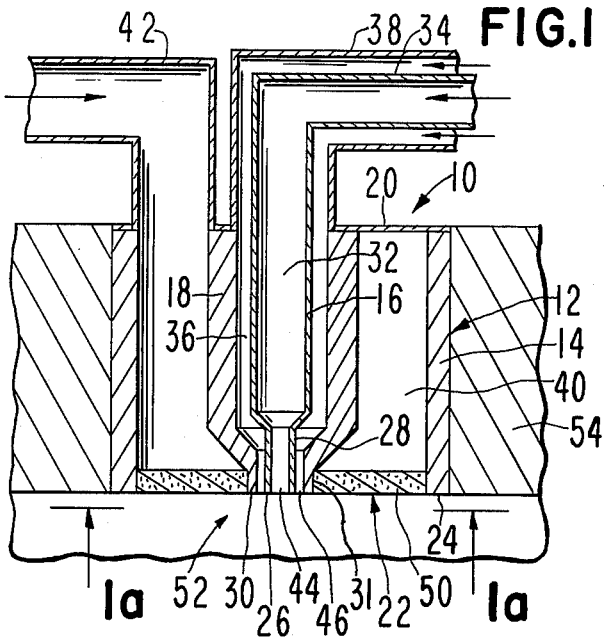
FIG.1
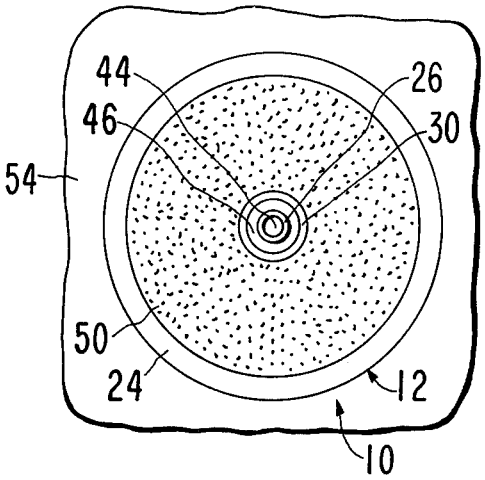
FIG.1a
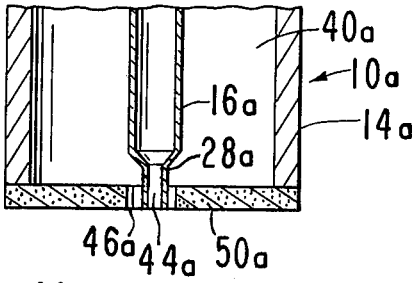
FIG.2
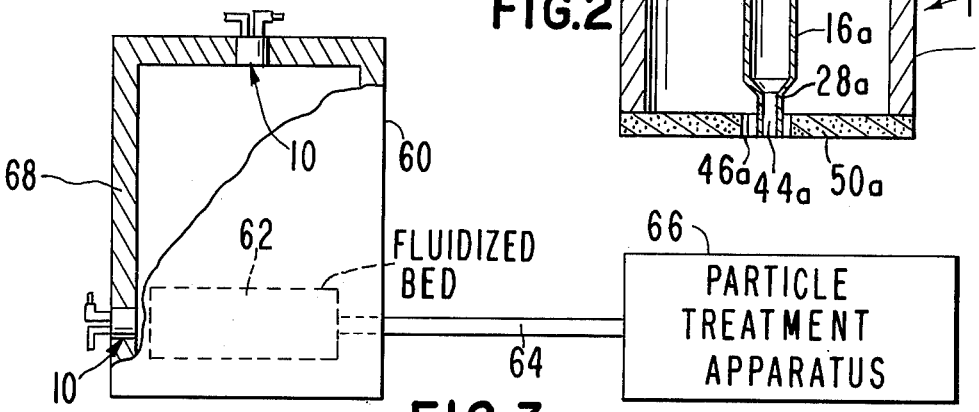
FIG.3
FIG.4
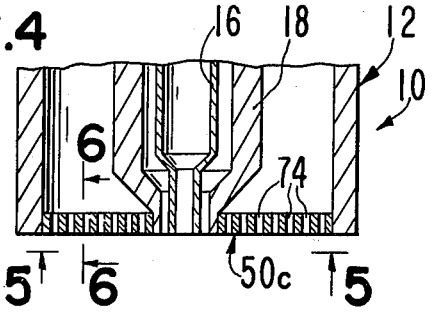
FIG.7
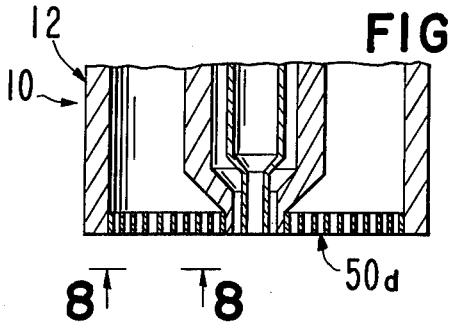
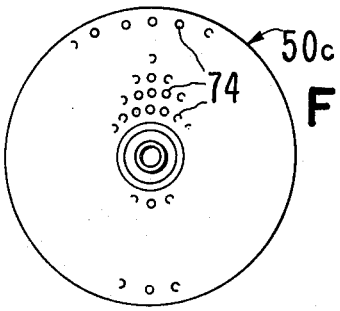
FIG.5
FIG.6
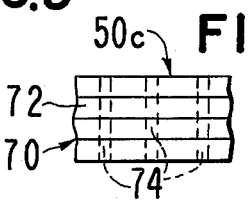
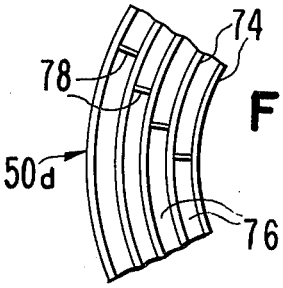
FIG.8

FLUID DELIVERY NOZZLE WITH FLUID PURGED FACE

This invention relates to improvements in the construction of the fluid delivery nozzles and, more particularly, to a nozzle which provides a low velocity fluid buffer to prevent the obstruction of the exit orifice thereof due to caking of solids thereon.

BACKGROUND OF THE INVENTION

In the atomization of fluids having strong nozzle-caking tendencies, such as fluids containing dissolved or suspended solids therein, the fluids are delivered by a nozzle having an exit orifice from which the fluid issues. The spray pattern from the exit orifice typically is such that a fraction of the fluid mass is caused to circulate, i.e., bend and reverse, immediately after leaving the exit orifice. This circulating flow causes the fluid to contact the downstream face of the nozzle causing the fraction to attach itself by surface tension or the like to such face. The fluid thereafter dries and the solids therein remain attached to the nozzle face in the form of a residue. This residue eventually builds up to such an extent that the exit orifice becomes completely or at least partially blocked, thereby impeding the proper fluid flow therethrough. This blocking action can occur even though a second atomizing fluid is used to shape or to enhance the atomization of the fluid containing the dissolved or suspended solids. As a result of such obstruction, fluid delivery through the nozzle must be halted periodically to remove the caked material so that proper delivery of the primary fluid can continue.

A typical fluid delivery environment in which the above problem becomes critical is in the handling of radioactive wastes containing dissolved or suspended radioactive solids in a slurry. Before disposal, such a fluid or slurry waste must be treated to remove the radioactive material therefrom. One way of treating the waste is to pass it through a calciner having a fluid bed comprised of heated, dried particles of the solids contained in the previous charges of the waste. The particles of the fluid bed are distributed substantially uniformly throughout the volume of the fluid bed and such particle distribution is essential to assure the proper formation and collection of subsequent particles from the calcined waste so that the particles can be removed from the fluid bed and directed to apparatus external to the calciner for further treatment.

The radioactive waste solution is directed at relatively high velocity into the calciner by a spray nozzle which is located above and in spaced relationship to or directly into the aforesaid fluid bed. The solids in such solution, when leaving the exit orifice of such a nozzle, have a tendency to circulate and thereby reverse in flow as described above, causing caking on the face of the nozzle at least adjacent to but more likely surrounding the exit orifice of the nozzle. Eventually, this caking obstructs the exit orifice to the extent that flow of the radioactive waste solution must be halted until the caked material is removed; otherwise, proper operation of the system cannot continue without sacrificing its yield.

Another disadvantage of using a spray nozzle with a calciner having a fluid bed is that the caked material could and often does get heavy enough near the face of the nozzle to cause the caked material to fall by gravity onto the fluid bed. The caked material, therefore, passes downwardly and through the fluid bed, thereby destroying its integrity and reducing its effectiveness for use in collecting particulate solids resulting from calcination.

SUMMARY OF THE INVENTION

The present invention provides an improvement over conventional nozzles by providing a nozzle which eliminates the problem due to caking of solids on the face of the nozzle adjacent to an exit orifice. Thus, if the fluid to be delivered by the nozzle contains solids, such as salts or the like, in suspension or solution, such solids will be prevented from caking on the nozzle so as to eliminate clogging or otherwise obstructing the nozzle orifice itself.

To this end, the nozzle of the present invention has a body provided with first fluid passage therethrough for delivering a primary fluid to be directed into a space, and a second fluid passage adjacent to the first fluid passage for receiving a purging fluid. Both passages have respective exit orifices and the second passage has means across its orifice to distribute the purging fluid uniformly across at least a major portion of the face of the nozzle and to deliver the purging fluid at relatively low velocity and at a relatively low volume rate of flow to a region immediately downstream of such face. In this way, the purging gas passing through the distributing means defines a fluid buffer or barrier between the nozzle and the circulating flow of the primary fluid so that the primary fluid, with its solids in suspension or solution, cannot contact the nozzle in any way to cause caking of the solid material as the primary fluid eventually dries.

The nozzle of the present invention is suitable for a number of different applications but it is especially suitable for use in delivering radioactive waste solutions to a calciner so that such waste solutions can be treated to separate the liquid and solid fractions of the solution. In operating in a calciner, the nozzle prevents the build-up of caked material on the surface of the nozzle adjacent to its exit orifice. Moreover, by eliminating the build up of such caked material, such material cannot fall by gravity into the lower portion of the calciner and destroy the fluid bed essential thereto.

Another aspect of the nozzle of this invention is that it can be constructed to permit delivery of an atomizing fluid, such as air, to enhance the atomization of the primary fluid. Also, by proper design of the nozzle, a portion of the atomizing fluid can be used as the purging fluid. Either or both of the atomizing and purging fluids can serve as a thermal insulator or as a heating or cooling medium for the primary fluid. Thus, the primary fluid will be protected against premature adverse phase changes that may otherwise occur by way of heat transfer to or from the mounting wall for the nozzle or to or from the media into which the primary fluid is directed.

Other uses of the nozzle include injection spraying of solutions and the like into spray dryers, incinerators, furnaces and other drying or combustion devices. It may also find application in processes which are dependent upon the achievement of a rapid mixing of two or more components with simultaneous atomization, e.g., two-part spray coating systems.

The fluid distribution means for the purging fluid can be of any suitable construction so long as it forms a plurality of very small fluid ducts or holes by means of which a relatively large mass of purging fluid will be uniformly distributed at the downstream face of the distributing means. To this end, the distributing means can be of a sintered material, a screen-like material, a platelet assembly or a series of spaced concentric rings in proximity to each other to define minute slots therebetween.

The primary object of this invention is to provide an improved nozzle suitable for use with fluids having dissolved or suspended solids providing nozzle-caking tendencies thereof wherein the nozzle has means to eliminate such caking to avoid obstructing the exit orifice of the nozzle irrespective of fluid flow rates of the fluid therethrough.

Another object of this invention is to provide a nozzle of the type described wherein the nozzle has a pair of fluid passages, one passage being utilized for a primary fluid to be delivered and another passage for delivering a purging fluid to a region adjacent to the orifice of the first passage, so that the purging fluid will form a fluid buffer or barrier between the nozzle itself and the circulating flow of the primary fluid to thereby substantially eliminate contact of the primary fluid to cake with the nozzle body after the primary fluid leaves the same to thereby avoid obstructing the exit orifice of the nozzle.

Still another object of this invention is to provide a nozzle of the aforesaid character wherein the nozzle is provided with fluid distribution means across the orifice of the purging fluid passage so that the flow of the purging fluid will be uniformly distributed in a region adjacent to the exit orifice of the primary fluid to thereby present the aforesaid fluid barrier.

Other objects of this invention will become apparent as the following specification progresses, reference being had to the accompanying drawing for an illustration of several embodiments of the invention.

In the drawings:

FIG. 1 is a cross-sectional view of one embodiment of the nozzle of this invention;

FIG. 1*a* is a view of the nozzle of FIG. 1 looking in the direction of lines 2—2;

FIG. 2 is a view similar to FIG. 1 but showing another embodiment of the nozzle;

FIG. 3 is a schematic view of a fluid handling system using the nozzle;

FIG. 4 is a view similar to FIG. 1 but showing a third embodiment of the nozzle.

FIGS. 5 and 6 are views of the nozzle of FIG. 4 looking in the directions of lines 5—5 and 6—6, respectively;

FIG. 7 is a view similar to FIG. 4 but showing another embodiment of the nozzle; and FIG. 8 is an enlarged view of the nozzle of FIG. 7 looking in the direction of line 8—8 of FIG. 7.

A preferred embodiment of the nozzle of this invention is broadly denoted by the numeral 10 and includes a body 12 having a generally cylindrical outer wall 14, a generally cylindrical inner wall 16 and a generally cylindrical intermediate wall 18 between the walls 14 and 16. Body 12 has a rear wall 20 and a front wall 22, the latter including an annular front face 24 on outer wall 14, an annular front face 26 on a reduced front cylindrical portion 28 of wall 16, and an annular front face 30 on a reduced front cylindrical portion 31 of wall 18.

Wall 16 and its reduced portion 28 define a first fluid passage 32 for a primary fluid or feed stream from a suitable source (not shown). A conduit 34 couples such source with the upstream end of passage 32. A second fluid passage 36 is formed between walls 16 and 18 and between reduced portions 28 and 31 thereof. Passage 36 is substantially annular in cross section and is adapted to be coupled by a conduit 38 to a source of an atomizing fluid, such as air or the like.

A third fluid passage 40 is formed between walls 14 and 18 and surrounds the same. Passage 40 is adapted to receive a purging fluid, such as air or the like, from a suitable source by a conduit 42. If air is used both for the atomizing and purging action to be described, then passage 40 can be in fluid communication with conduit 38 so as to eliminate the need for conduit 42. Passages 32 and 36 have respective exit orifices 44 and 46 in the plane of front faces 24, 26 and 30. Passage 40 is terminated by the purging fluid distribution member 50 in the plane of its front face 22.

Front wall 22 of nozzle 10 is formed by a porous distribution member 50 which extends across fluid flow passage 40. For purposes of illustration, member 50 is annular (FIG. 2) but it can have other configurations as well. Member 50 operates to distribute the purging fluid flowing through passage 40 so that such purging fluid is uniformly distributed in the region denoted by the numeral 52 immediately downstream of member 50 and in substantially surrounding relationship to the region immediately downstream of exit orifice 44 of passage 32. Moreover, member 50 further causes a pressure drop of the purging fluid so that the purging fluid emerges from member 50 at its face 22 at a relatively low velocity and at a relatively low volume rate of flow.

As shown in FIG. 1, the diameter of the inner periphery of member 50 is approximately twice the diameter of orifice 44. The diameter of the outer periphery of member 50 is approximately 10 to 20 times greater than the diameter of orifice 44. Thus, the effective front face area of member 50 is a number of times greater than the front face area of orifice 44.

In use, nozzle 10 is mounted in any suitable manner in a support 54, such as the wall of a vessel into which the primary fluid is to be directed. Conduits 34, 38 and 42 are then coupled to sources of primary fluid, atomizing fluid and purging fluid, respectively, and the fluids are allowed to flow in the direction of the arrows shown in the corresponding conduits. The purging fluid passing through conduit 42 enters nozzle 10 and, because passage 40 surrounds wall 18, the purging fluid fills the entire volume of passage 40 and flows toward and through porous distribution member 50. The purging fluid flows out of member 50 to form a low velocity buffer or barrier to the fraction of the primary fluid which tends to circulate, i.e., bend around and move in reverse toward face 22 immediately after leaving exit orifice 44. As a result, none of the primary fluid can contact face 22 so that caking of solid material on this face is substantially eliminated. Thus, there will be no obstruction of exit orifices 44 and 46 which would impair the operation of nozzle 10.

The primary fluid and the atomizing fluid are subjected to pressures and move at velocities equivalent to those encountered with conventional atomizing nozzles. A typical pressure of the purging fluid in passage 40 is 35 to 40 psi. At this pressure, a suitable distributing member 50 can comprise a thickness of about ⅛-inch of sintered stainless steel.

The purging fluid can be either a liquid or gas but normally will be the latter. If air forms both the purging and atomizing gases, it is preferred that conduit 42 be separate from conduit 38 so that positive control of the flow of the purging fluid can be more easily exercised.

Distributor member 50 may be of any one of a number of different types and materials that is usually of metal and has a fine pore size with a uniform distribution of pores therethrough. Sintered porous metals and partially sintered, pressed, multi-layered screen composites have been demonstrated to be practical porous face materials. A suitable mult-layered screen composite adapted for this use is made and sold under the mark "RIGIMESH" by the Pall Corp., 30 Seacliff Avenue, Glencove, New York. Other types of distributing means are shown in FIGS. 4–8 and are described hereinafter.

Nozzle 10, in addition to overcoming nozzle-caking problems, provides an additional advantage in that it provides an internal means of thermally protecting the inner flow circuits, i.e., the primary and atomizing fluid flows, from unacceptable heat gains or losses from or to the nozzle mounting support 54 or to the media into which the primary and atomizing fluids are directed. For example, the purging fluid can provide cooling to a volatile primary fluid and prevent internal vaporization thereof even when mounting structure 54 and/or the media into which the primary fluid is sprayed or directed is far above the boiling point of the primary fluid itself. Similar protection can be afforded to any primary fluid against freezing, boiling, thermal degradation or the like by proper design of the purging fluid circuit and by temperature and flow control of the purging fluid supply.

A specific application of nozzle 10 is its use with a calciner 60 (FIG. 3) of the type having a fluidized bed 62 internally thereof, the fluidized bed being formed of a plurality of a plurality of dried particles in suspension which continuously or periodically are transferred by way of conveyor means 64 to particle treatment apparatus 66, such as particle storage and disposal means. Nozzle 10 can be mounted in the wall 68 of calciner 60 either at a first location above fluidized bed 62 or at a second location directly into the fluid bed. A typical primary fluid injected under pressure in the calciner 60 through nozzle 10 comprises radioactive waste solutions containing solids in solution or in suspension, the purpose of the calciner being to separate the liquid and solid fractions from each other and to collect the radioactive solid fractions in the fluid bed and to transfer the same to apparatus 66 for further treatment, such as packaging and immobilization.

It is preferred that nozzle 10 be useable in the lower position of FIG. 3 so that the primary fluid is injected directly into the fluid bed from one or more sides thereof. This can be done without adversely affecting the composition of the fluid bed and is done for two reasons; namely, to prevent fines injected into the space above the fluid bed (when nozzle 10 is in the upper portion of FIG. 3) from passing out of the calciner with the vapor formed by the calcination, and to provide the opportunity for the fines injected into the fluid bed from the side thereof to become attached to the relatively larger particles of the fluid bed to thereby reduce the tendency for such fines to move upwardly from the fluid bed and out of the calciner with the vapor formed by calcination.

Another embodiment of the nozzle, denoted by the numeral **10*a*, is shown in FIG. 2 and is substantially the same as nozzle 10 of FIG. 1 except for the elimination of wall 18 so that a single fluid, forming the atomizing and purging fluids, enters passage 40*a* surrounding a cylindrical inner wall 16*a*, passage 40*a* being surrounded by a cylindrical outer wall 14*a*. Thus, a fraction of the single fluid in the passage 40*a* exits via orifice 46*a* and is used for atomizing the primary fluid flowing through passage 44*a* and the remainder is used to purge the face of distribution member 50*a* which terminates the major portion of passage 40*a*. To this end, the outer end of reduced portion 28*a* of wall 16*a* is extended to the frontal plane of member 50*a* to form an annular atomizing port 46*a* through which the fraction of the single fluid in the passage 40*a* passes to atomize the primary fluid. The remainder of the single fluid in passage 40*a* flows through member 50*a* and exits therefrom to present the fluid buffer to the portion of the primary fluid which tends to circulate and return to the outer face of member 50*a***.

FIGS. 4–6 show a second embodiment of a distribution member broadly denoted by the numeral **50*c*. Member 50*c* is formed of a platelet assembly 70 comprised of a plurality of stacked, interconnected plates 72 which are etched or otherwise formed to present a plurality of very small, closely spaced, uniformly spaced holes 74 therethrough. For purposes of illustration, the holes lie on radial lines relative to the central axis of member 50*c*. While not shown, the platelets can be etched to provide circular holes 74 in patterns other than the radial one shown in FIG. 5. While a circular face is shown for distributor member 50*c***, it is clear that it can have other configurations as well, such as square or rectangular.

Still another form of the distributor member is shown in FIGS. 7 and 8 and is broadly noted by the numeral **50*d*. Member 50*d* is comprised of a plurality of concentric rings 74 which are very close together (greatly exaggerated in FIG. 8) so as to present a plurality of very narrow slots 76 through which the purging fluid passes. Slots 76 uniformly distribute the purging fluid so that the purging fluid forms a fluid buffer immediately downstream of member 50*b*. Very short webs 78 are provided to separate the rings 74** from each other. These webs can either be circumferentially staggered or radially aligned with each other, whichever is more desirable.

We claim:

1. A method of handling a first fluid having dissolved or suspended solids therein comprising: directing said first fluid along a confined path having an exit end; injecting the first fluid from said path into a region adjacent to the exit end of the path; and forming a fluid buffer near said exit end of said path to prevent any substantial rearward flow of the first fluid after it exits from said path to thereby prevent the build up of said solids at said exit end of the path by directing a second, pressurized fluid to a point proximate said exit end, dividing the second fluid into a multiplicity of second fluid streams and discharging the streams in an exit end surrounding relation to thereby generate in said region a relatively low pressure, low velocity and low volume buffer defined by the second fluid, said buffer flowing in the same direction as the first fluid flowing in said region; whereby the buffer flow prevents the backflow of injected first fluid and thereby also prevents said build up of solids.

2. A method according to claim 1 wherein the step of discharging the streams in an exit end surrounding relation comprises the steps of discharging the streams from a point proximate the exit end of the path to a point spaced from the exit end a distance which exceeds a transverse extent of the exit end by a plurality of times.

3. A method according to claim 2 wherein the distance exceeds the transverse width by up to 20 times.

4. A method as set forth in claim 1, wherein is included the step of atomizing the first-mentioned fluid with a portion of the second fluid.

5. A method as set forth in claim 1, wherein is included the step of atomizing the first-mentioned fluid with a third fluid.

6. In a system for handling fluids having dissolved or suspended solids therein, a fluid nozzle comprising: a body defining a downstream body end and having a first fluid passage extending through the body and terminating in a fluid exit orifice coincident with the end; a second fluid passage extending through the body and terminating adjacent the end; means for connecting the passages with sources of pressurized first and second fluids for flowing the fluids through the first and second passages, respectively; and distributing means connected with the body, surrounding the orifice and defining a multiplicity of evenly distributed, relatively small cross section passageways communicating the second passage with the exterior of the body end for causing a relatively low pressure, low velocity and low volume flow of the second fluid from the second passage to the exterior; whereby the second fluid discharged by the passageways forms a fluid buffer preventing first fluid discharged by the orifice from backflowing and adhering to the body end.

7. A system according to claim 6 wherein the distributing means comprises a plate member attached to the body, and wherein the passageways extend transversely across the plate member.

8. A system according to claim 7 wherein the plate member has an inner edge surrounding the orifice and spaced from the orifice to thereby define a generally annular, unobstructed exit port for discharging at a substantially unimpeded pressure, volume and velocity a portion of the second fluid in surrounding relationship to the first fluid discharged by the orifice.

9. A system according to claim 6 wherein each of the orifice and the distributing means have a transverse extent generally perpendicular to the fluid flow through the orifice and the passageways, and wherein the transverse extent of the distributing means is several times as large as the transverse extent of the orifice.

10. A system according to claim 9 wherein the transverse extent of the distributing means is between about ten to about 20 times larger than the transverse extent of the orifice.

11. A system as set forth in claim 6 wherein said distributing means comprises a member of sintered material.

12. A system as set forth in claim 6 wherein said distributing means comprises a mesh having a number of superposed layers.

13. A system as set forth in claim 6 wherein is included a third passage between the first passage and the second passage and having an exit orifice adjacent to the exit orifice of the first passage, the third passage adapted to be coupled with a source of an atomizing fluid.

14. A system as set forth in claim 6 wherein said body has a first tubular wall defining the second passage, said distributing means including a porous member extending inwardly of said second wall and terminating in spaced relationship to the first wall to present an exit port, whereby a first portion of the second fluid can flow through said exit port to atomize said first fluid and a second portion of the second fluid can flow through said distributing means to form said fluid buffer.

15. A system as set forth in claim 6 wherein said distribution means comprises a platelet assembly.

16. A system as set forth in claim 6 wherein said distribution means comprises a member having a plurality of concentric rings surrounding the orifice of the first passage, the space between each pair of adjacent rings defining a generally arcuate pore through which the second fluid passes.

17. A fluid nozzle for fluids having dissolved or suspended solids therein comprising: a body including means defining a first fluid discharge orifice, means defining a concentric second fluid discharge nozzle, porous plate means surrounding the second nozzle and having an extent transverse to the second nozzle which exceeds the transverse extent of the second nozzle by a plurality of times, conduit means connected with respective sources of pressurized fluids for flowing pressurized fluids through the first and second orifices and against an inside of the plate means so that fluid is discharged by pores of the plate means in an orifice surrounding pattern at a relatively low pressure, velocity and volume to define a fluid buffer between an outside of the plate means and fluid discharged and atomized by the orifices to prevent a backflow of fluid discharged from the orifices, the deposition of solids on the outside of the plate means, and a resulting caking of solids on a downstream end of the body.

18. A nozzle according to claim 17 wherein the means defining the second orifice includes a wall of the plate means extending in the direction of fluid flow through the second orifice and surrounding the first orifice defining means in spaced apart relation.

19. A nozzle according to claim 18 wherein the means for flowing the fluids includes means for flowing the same fluid to the second orifice and the inside of the plate means so that a portion of the second fluid is discharged at a relatively high velocity and volume through the second orifice and a remainder of the second fluid is discharged through the pores of the plate means at a relatively low volume and velocity to form said fluid buffer.

20. A method for atomizing a liquid having dissolved or suspended solids therein comprising the steps of pressurizing the liquid and discharging it through a first orifice; pressurizing a fluid and discharging it from another orifice contiguous with the first mentioned orifice to thereby atomize the liquid into a space surrounding the orifices; and preventing atomized portions of the liquid from backflowing relative to the orifice and depositing and building up in a region surrounding the orifices by forming and flowing a multiplicity of small cross-section fluid streams arranged in an orifice surrounding pattern and substantially evenly distributing the streams over an orifice surrounding area which extends from about the peripheries of the orifices over a distance which is a plurality of times larger than the cross-section of the orifices in a direction transverse to the fluid flow therethrough; whereby the streams combine into a relatively low pressure, low velocity and low volume buffer fluid flow flowing generally parallel to the direction in which the liquid is discharged from its orifice so that the buffwer flow carries with it and thereby prevents a backflow of atomized liquid and thus a deposit and build-up of solids in a region surrounding the orifices.

21. A method according to claims 20 wherein the steps of flowing a fluid through the another orifice and of forming and flowing fluid streams comprises the step of flowing the same fluid through the second orifice and the streams.

22. A method according to claim 20 wherein the steps of flowing a fluid through the another orifice and of forming and flowing fluid streams comprises the steps of flowing a second fluid through the second orifice and flowing a third fluid in the streams.

23. In a system handling fluids having dissolved or suspended solvents therein, a fluid nozzle comprising: a body having a first tubular wall defining a first passage and a second tubular wall defining a second passage, each of the passages having an exit orifice and adapted to be coupled with a source of a respective fluid; and distributing means across the second exit orifice of the second passage including a porous member extending inwardly of the second wall and terminating in a spaced relationship to the first wall to present an exit port, whereby a first portion of the second fluid can flow through the exit port to atomize the first fluid and a second portion of the second fluid can flow through the porous member to distribute the second portion of the second fluid substantially uniformly over a region immediately downstream of the orifices to present a fluid buffer in said region.

* * * * *